US009016433B1

(12) United States Patent
Duffy

(10) Patent No.: US 9,016,433 B1
(45) Date of Patent: Apr. 28, 2015

(54) FIREFIGHTER SAFETY DEVICE

(71) Applicant: Robert S. Duffy, Wilbraham, MA (US)

(72) Inventor: Robert S. Duffy, Wilbraham, MA (US)

( * ) Notice: Subject to any disclaimer, the term of this patent is extended or adjusted under 35 U.S.C. 154(b) by 199 days.

(21) Appl. No.: 13/743,378

(22) Filed: Jan. 17, 2013

Related U.S. Application Data

(60) Provisional application No. 61/588,402, filed on Jan. 19, 2012.

(51) Int. Cl.
*E04G 1/36* (2006.01)
*E04G 3/26* (2006.01)

(52) U.S. Cl.
CPC ..... *E04G 3/26* (2013.01)

(58) Field of Classification Search
CPC ..... E04B 3/26
USPC ..... 182/45; 248/148, 237
See application file for complete search history.

(56) References Cited

U.S. PATENT DOCUMENTS

| | | | | | |
|---|---|---|---|---|---|
| 298,463 | A | | 5/1884 | Guedle | |
| 341,178 | A | | 5/1886 | Specht | |
| 524,661 | A | * | 8/1894 | Austin | 182/156 |
| 528,169 | A | * | 10/1894 | Burk | 248/237 |
| 599,963 | A | | 3/1898 | Hatch | |
| 677,645 | A | | 7/1901 | Elkins | |
| 856,932 | A | | 6/1907 | Wootan | |
| 955,159 | A | * | 4/1910 | Hilmon | 182/45 |
| 960,565 | A | * | 6/1910 | Levander | 248/237 |
| 1,006,562 | A | | 10/1911 | Kefover | |
| 1,028,362 | A | | 6/1912 | King | |
| 1,143,555 | A | | 6/1915 | Schimmelpfennig | |
| 1,267,056 | A | * | 5/1918 | Chappus | 182/45 |
| 1,684,269 | A | | 3/1927 | Hebner | |
| 1,743,371 | A | | 4/1928 | Montag | |
| 2,320,538 | A | * | 6/1943 | Vogt | 182/45 |
| 2,575,254 | A | | 4/1949 | Blaugrund | |
| 3,526,296 | A | * | 9/1970 | Stevens | 182/45 |
| 3,866,715 | A | | 2/1975 | Foulk | |
| 4,249,713 | A | | 2/1981 | Glynn et al. | |
| 4,279,327 | A | | 7/1981 | Warren | |
| 4,450,935 | A | | 5/1984 | Gustavus | |
| 4,531,613 | A | | 7/1985 | Keigher | |
| 4,632,219 | A | | 12/1986 | Rayer | |
| 4,901,818 | A | | 2/1990 | Schmitt | |
| 4,928,789 | A | * | 5/1990 | Claeys | 182/3 |
| 5,050,705 | A | | 9/1991 | Natwick | |
| 5,137,112 | A | | 8/1992 | Nichols | |
| 5,165,659 | A | | 11/1992 | L'Heureux | |
| 5,248,021 | A | | 9/1993 | Nichols | |
| 5,249,397 | A | * | 10/1993 | Monaco | 52/126.1 |
| 5,287,944 | A | | 2/1994 | Woodyard | |
| 5,318,148 | A | * | 6/1994 | Franco et al. | 182/45 |
| 5,346,036 | A | | 9/1994 | Arisman et al. | |
| 5,474,271 | A | * | 12/1995 | Raymond | 248/237 |
| 5,553,685 | A | | 9/1996 | Cook | |

(Continued)

*Primary Examiner* — Katherine Mitchell
*Assistant Examiner* — Candace L Bradford
(74) *Attorney, Agent, or Firm* — Deborah A. Basile; Karen K. Chadwell

(57) ABSTRACT

A safety device comprising a foothold in association with a mounting assembly, wherein the position of the foothold relative to the mounting assembly is adjustable, thereby allowing the safety device to be used on a variety of sloped roofs. The safety device may further comprises a firefighter securing assembly which provides a means whereby an operator may secure himself to the safety device thereby preventing the operator from falling from the roof in the event the operator loses his balance.

8 Claims, 6 Drawing Sheets

(56) References Cited

U.S. PATENT DOCUMENTS

| | | | | |
|---|---|---|---|---|
| 5,570,864 | A | 11/1996 | Flores | |
| 5,624,006 | A * | 4/1997 | Richardson, Jr. | 182/45 |
| 5,730,407 | A | 3/1998 | Ostrobrod | |
| 5,791,438 | A * | 8/1998 | Kempton | 182/200 |
| 5,829,203 | A | 11/1998 | Ealer, Sr. | |
| 5,845,740 | A | 12/1998 | Bouwkamp | |
| 5,850,889 | A | 12/1998 | Rexroad et al. | |
| 5,862,880 | A | 1/1999 | Nelson et al. | |
| 5,896,719 | A | 4/1999 | Thornton | |
| 5,960,904 | A * | 10/1999 | Ullmann | 182/45 |
| 5,975,239 | A | 11/1999 | Castaneda | |
| 5,979,600 | A * | 11/1999 | Bitner | 182/45 |
| 6,045,102 | A * | 4/2000 | Terenzoni | 248/238 |
| 6,216,819 | B1 * | 4/2001 | Cougar | 182/45 |
| 6,220,390 | B1 * | 4/2001 | Pike | 182/45 |
| 6,298,945 | B1 | 10/2001 | Anders et al. | |
| 6,779,316 | B2 | 8/2004 | Carroll | |
| 6,966,531 | B2 | 11/2005 | Curtin | |
| 7,036,629 | B2 | 5/2006 | Nicolaysen | |
| 7,044,270 | B1 | 5/2006 | McIntire et al. | |
| 7,124,988 | B1 * | 10/2006 | Duffy et al. | 248/284.1 |
| 7,240,770 | B2 | 7/2007 | Mullins et al. | |
| 7,338,032 | B2 | 3/2008 | Sykes, Jr. | |
| 7,354,025 | B2 * | 4/2008 | Searle | 248/237 |
| 7,568,671 | B2 * | 8/2009 | Lallier | 248/237 |
| 7,896,131 | B2 * | 3/2011 | Bronkhorst | 182/45 |
| 8,025,126 | B1 | 9/2011 | Lefavor | |
| 8,596,414 | B1 * | 12/2013 | Lown | 182/45 |
| 2003/0217890 | A1 * | 11/2003 | Nicolaysen | 182/45 |
| 2005/0194212 | A1 * | 9/2005 | Board et al. | 182/45 |
| 2006/0260260 | A1 | 11/2006 | Blackford | |
| 2007/0034449 | A1 * | 2/2007 | Leendertse | 182/45 |
| 2007/0272485 | A1 * | 11/2007 | Baake | 182/45 |
| 2010/0307869 | A1 | 12/2010 | Hazuka, II et al. | |
| 2011/0011676 | A1 | 1/2011 | DeLair | |
| 2012/0080264 | A1 * | 4/2012 | Lord | 182/45 |
| 2012/0118667 | A1 * | 5/2012 | Fontaine | 182/45 |
| 2013/0240295 | A1 * | 9/2013 | Wallace | 182/45 |
| 2013/0313043 | A1 * | 11/2013 | Lallier | 182/45 |

* cited by examiner

FIREFIGHTER SAFETY DEVICE

BACKGROUND OF THE INVENTION

1. Field of the Invention

The present disclosure relates generally to a safety device, and more particularly, to a safety device useful in providing balance to a firefighter while the firefighter is venting a roof.

2. Background of the Invention

Roof ventilation is a common procedure performed by firefighters when putting out fires. Although the ventilation of a roof poses many hazards, one of these includes slips and/or falls from the roof. Presently known objects used to anchor the firefighter to the roof during the ventilation process include a roof ladder and a pick head axe, wherein the firefighter uses the head of the axe as a foothold during the ventilation process. However, when working from a roof ladder, the firefighter will often need to reach in a lateral direction from the ladder to cut the largest possible opening, which oftentimes leads to poor balance. Additionally, pick head axes provide too small of a surface area on which to maintain balance and support.

Accordingly, what is needed is a readily portable device that can be easily installed on the roof, which can provide proper support to the firefighter, and which can facilitate the ventilation of the roof by the firefighter.

BRIEF SUMMARY OF THE INVENTION

The above described deficiencies of the prior art are cured or alleviated by a safety device comprising a foothold comprising a body having a top side opposite to a bottom side, and an anterior wall opposite to a posterior wall. The safety device further comprises a first support subassembly and a second support subassembly, wherein each of the first and second support subassemblies comprises a rail having a top side opposite to a bottom side, an anterior side opposite to a posterior side, and a proximal lateral side opposite to a distal lateral side, wherein a channel is formed through the rail, and further wherein the bottom side of the rail is disposed on the bottom side of the foothold. Each of the first and second support subassemblies further comprises a foothold adjustment subassembly comprising a plate which engages with the channel of the rail to thereby adjust the position of the foothold; and a roof rest member comprising a body which is in communication with the foothold adjustment subassembly and the rail, wherein a bottom side of the roof rest member is disposed on an exterior side of a roof when the device is in use.

The safety device further comprises a first grip subassembly and a second grip subassembly, wherein each of the first and second grip subassemblies comprises a grip member having an arcuate shaped body, wherein a concave portion of the body is directed towards the top side of the body of the foothold, and further wherein the arcuate shaped body is received within a cut made in the roof when the device is in use.

The safety device may further comprise a securing member which serves to further support an operator when using the safety device. The safety device is particularly well adapted for use by a firefighter when the firefighter is ventilating a roof as it provides stability, is relatively simple to install, and is relatively lightweight and compact. The safety device is particularly well adapted for use by a firefighter as an anchor while fighting a fire on a roof.

These and other features and advantages of the present invention will be more fully understood from a reading of the following detailed description with reference to the accompanying drawings.

DETAILED DESCRIPTION OF THE INVENTION

Figure 1:
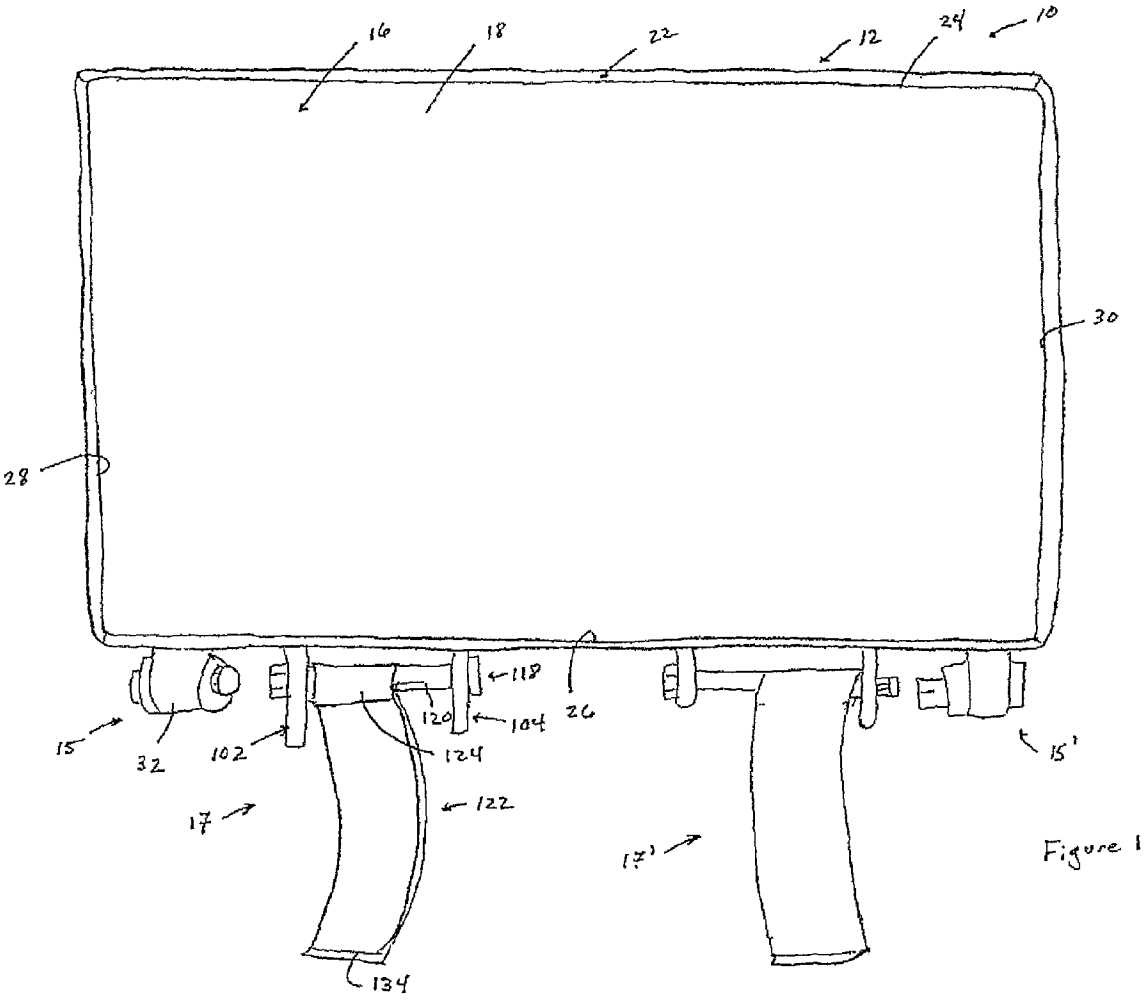
FIGS. 1 and 2 are schematics depicting a top side of an exemplary firefighter safety device.
Figure 2:
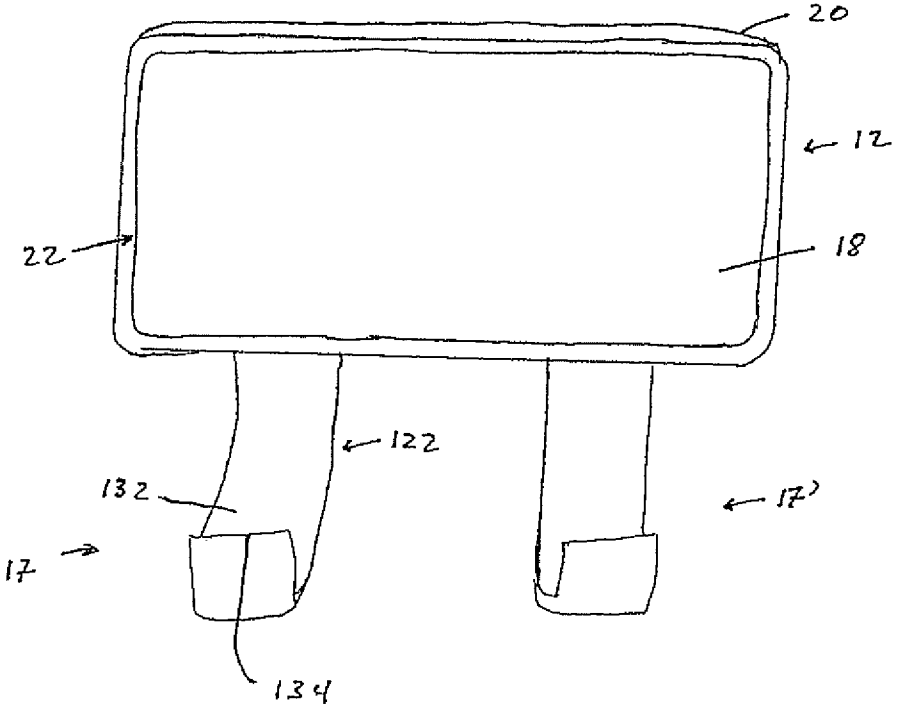
Figure 3:
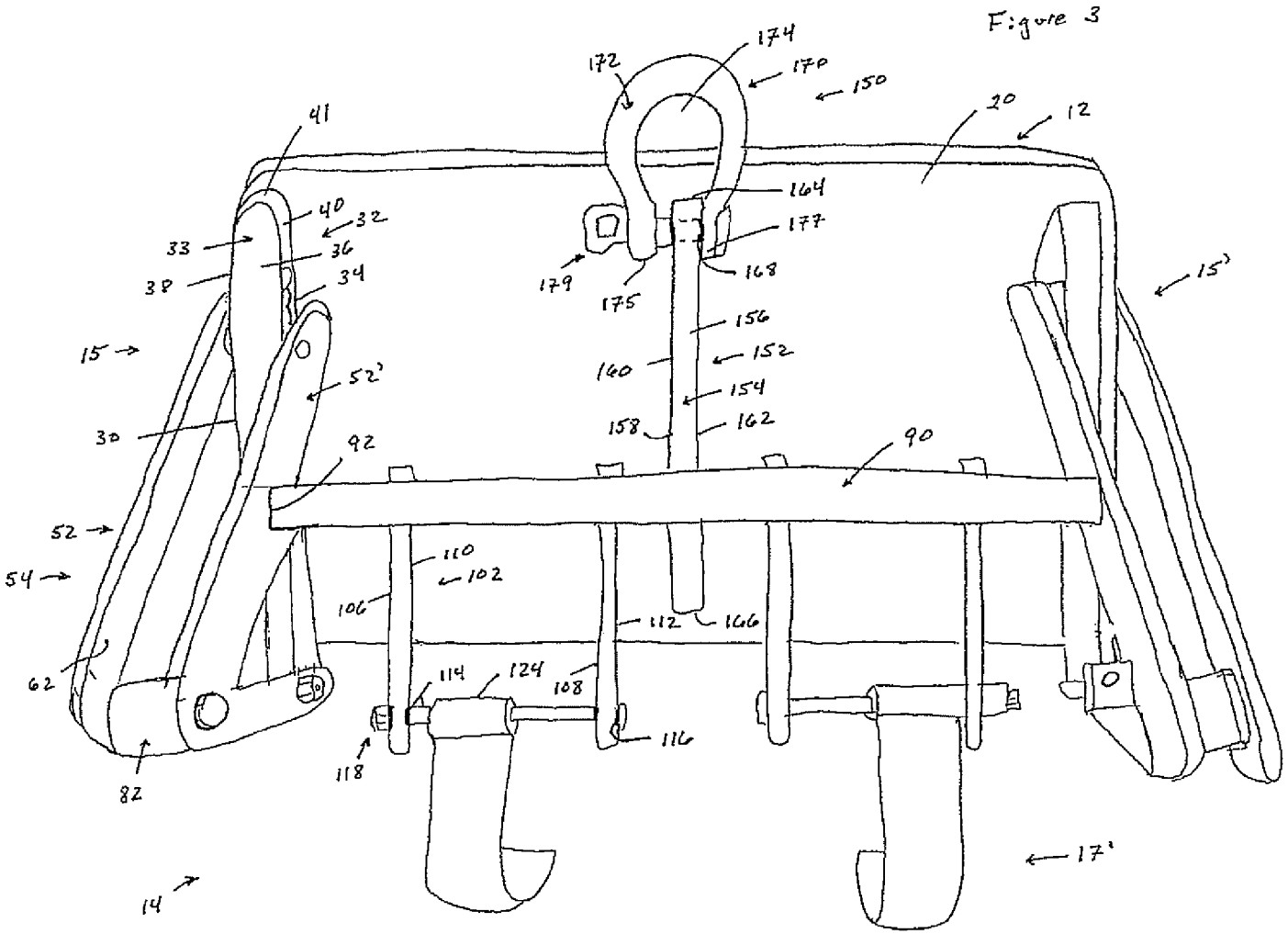
FIG. 3 is a schematic depicting a bottom side of the firefighter safety device depicted in FIGS. 1 and 2.
Figure 4:
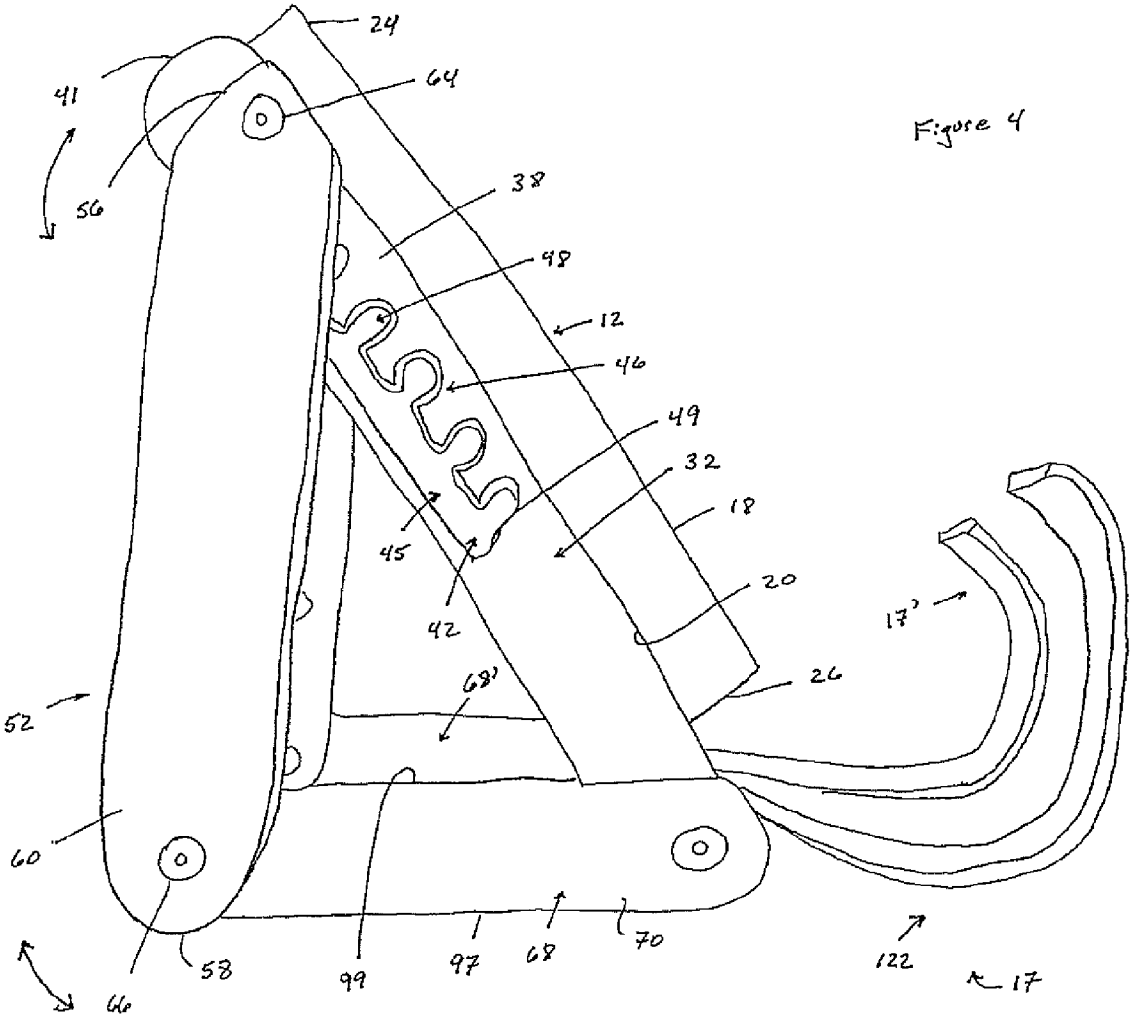
FIG. 4 is a schematic depicting a side view of the firefighter safety device depicted in FIGS. 1-3.
Figure 5:
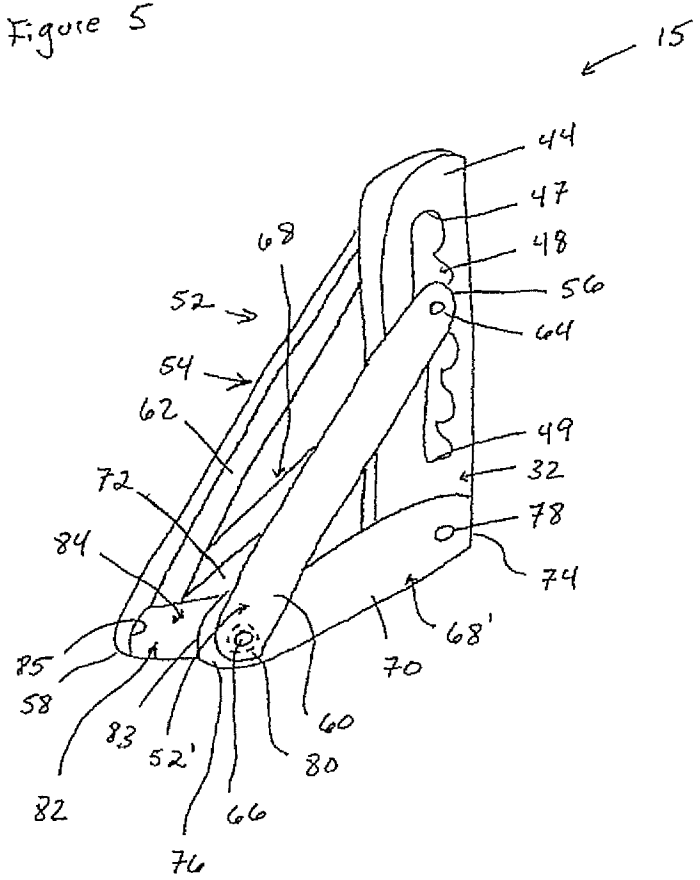
FIGS. 5 and 6 are schematics depicting an exemplary support subassembly.
Figure 6:
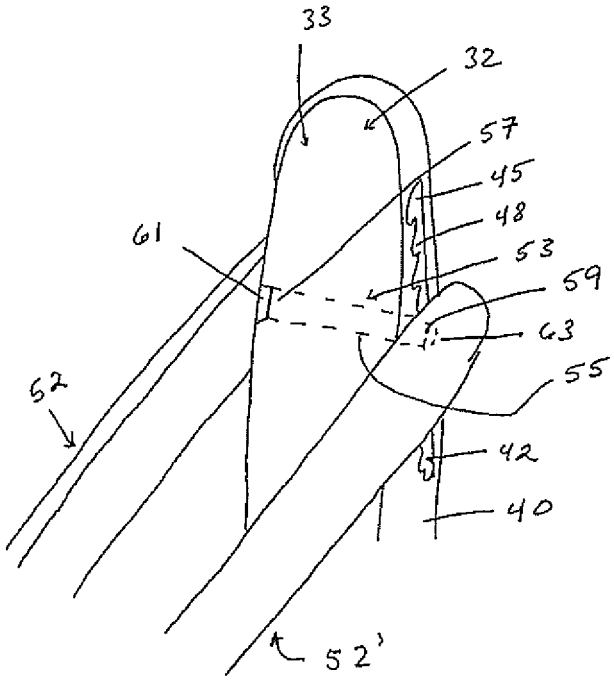

The safety device of the present invention is specially designed to be installed on a roof to provide greater stability to a firefighter when the firefighter is engaged with fighting a fire and/or ventilating the roof. The safety device comprises a foothold and a mounting assembly, wherein the position of the foothold relative to the mounting assembly is adjustable to accommodate a variety of pitched roofs. The foothold provides a means whereby a firefighter may stand upon the safety device to provide balance and stability when the firefighter is on the roof, while the mounting assembly provides a means whereby the device is mounted and secured to the roof, and further provides a means whereby the angle of the foothold may be adjusted to thereby allow the safety device to be used effectively on a variety of pitched roofs.

In an exemplary embodiment, the mounting assembly comprises a pair of support subassemblies and a pair of grip subassemblies. Each of the support subassemblies from the pair comprises a rail, a foothold adjustment subassembly, and a roof rest member. The rail may be disposed on the foothold, while the foothold adjustment subassembly may be slidably engaged with the rail and pivotally connected to the roof rest member. The roof rest member is configured such that it rests on an exterior surface of the roof when the safety device is in use.

In an exemplary embodiment, the mounting assembly further comprises a rod which is disposed on the foothold adjustment subassembly of each of the support subassemblies from the pair. The rod provides a ready means whereby an operator may adjust the position of the support subassemblies relative to the foothold.

Each of the grip subassemblies from the pair of grip subassemblies may comprise a mount in association with a grip member. In an exemplary embodiment, the mount is disposed on the foothold, and the grip members are rotatably engaged with the mount.

In an exemplary embodiment, each of the grip members comprises an arcuate shaped body. When in use, the arcuate shaped bodies of the grip members are disposed within a cut(s) made into a roof. The curved configuration of the arcuate shaped bodies assists in stabilizing the device to the roof as such configuration prevents the bodies from sliding out from the cut(s) made in the roof.

The safety device may further comprise an operator securing assembly. In an exemplary embodiment, the operator securing assembly comprises a plate which is disposed on the foothold. The operator securing assembly may further comprise a ring shaped member having an opening through which a fastening member, such as, for example, a lanyard, a rope, a tether, and the like, may be attached. An operator may attach the fastening member to himself thereby providing an effective means for preventing the operator from falling from the roof in the event the operator loses his balance.

An exemplary safety device shall now be described with reference to the figures, wherein it is understood that the embodiment depicted in the figures is exemplary only, and that the scope of the invention is not limited to the embodiment depicted therein.

Referring to the figures, an exemplary firefighter safety device 10 comprises a foothold 12 and a mounting assembly 14. Foothold 12 comprises a body 16 having a top side 18 opposite to a bottom side 20, an anterior wall 24 opposite to a posterior wall 26, and a proximal lateral wall 28 opposite to a distal lateral wall 30. Foothold 12 further comprises an abutment wall 22 which surrounds top side 18 of body 16 such that top side 18 is recessed relative thereto.

Mounting assembly 14 comprises a support subassembly 15, a support subassembly 15', a grip subassembly 17, and a grip subassembly 17'. Support subassembly 15 is substantially identical to support subassembly 15'; accordingly, the description shall describe support subassembly 15, wherein it is understood that, unless otherwise specifically stated, such description shall equally apply to support subassembly 15'.

Support subassembly 15 (and support subassembly 15') comprises a rail 32. Rail 32 comprises a longitudinally extending body 33 which comprises a bottom side 34 oppositely situated to a top side 36, a proximal lateral side 38 oppositely situated to a distal lateral side 40, and an anterior side 41 opposite to a posterior side 43. Bottom sides 34 of support subassembly 15 and 15' are fixedly disposed onto bottom side 20 of foothold 12 such that posterior sides 43 of rails 32 extend past posterior wall 26 of foothold 12. Rail 32 of subassembly 15 is positioned towards distal lateral wall 30 of foothold 12, and rail 32 of subassembly 15' is positioned towards proximal lateral wall 28 of foothold 12.

Rail 32 further comprises a channel 42 formed through proximal lateral side 38 and distal lateral side 40. Channel 42 begins at an anterior region 44 of body 33, and terminates approximately at a midline region thereof. Channel 42 comprises a substantially linear-shaped channel 45 which extends from an anterior region 44 of body 33 to expose a wall 47, and which terminates at an approximate midline region thereof to expose a wall 49. Channel 42 further respectively comprises a plurality of grooves 48 contiguously formed with channel 45. As will be discussed more fully below, grooves from plurality 48 are configured to provide a catch mechanism whereby the angle of foothold 12 may be adjusted.

Rail 32 further comprises a hole (not shown) formed through proximal lateral side 38 and distal lateral side 40 towards posterior side 43 of rail 32, and a hole (not shown) formed through proximal lateral side 38 and distal lateral side 40 towards anterior side 41 of rail 32.

Support subassembly 15 further comprises plates 52 and 52'. As plates 52 and 52' are substantially identical, a description of plate 52 shall be made wherein it is understood that, unless specifically stated otherwise, such description applies equally to plates 52'.

Plate 52 comprises a longitudinally extending body 54 having an anterior terminal end 56 opposite to a posterior terminal end 58, and having a front side 60 opposite to a back side 62. A hole 64 is formed through front side 60 and back side 62 near anterior terminal end 56, and a hole 66 is formed through front side 60 and back side 62 near posterior terminal end 58.

Each of support subassemblies 15 and 15' further comprises an upper connector member 53. Upper connector member 53 of support subassembly 15 is disposed through the hole formed through proximal lateral side 38 and distal lateral side 40 towards anterior side 41 of rail 32, and joins plates 52 and 52' to rail 32. Similarly, upper connector member 53 of support subassembly 15' is disposed through the hole formed through proximal lateral side 38 and distal lateral side 40 towards anterior side 41 of rail 32 of support subassembly 15' to join plates 52 and 52' of support subassembly 15' to rail 32 of support subassembly 15'.

Upper connector member 53 comprises a shaft 55 having a proximal terminal end 57 oppositely situated to a distal terminal end 59. Shaft 55 is configured such that it can freely move through channels 45 of rails 32 of support subassemblies 15 and 15', and can be received by, and removably secured within, grooves 48 of rails 32 of support subassemblies 15 and 15'.

Attached to proximal terminal end 57 of upper connector member 53 is a buttress 61 and attached to distal terminal end 59 is a buttress 63. Upper connector member 53 is disposed through body 33 of rail 32 such that shaft 55 of upper connector member 53 is disposed within channel 42 and such that buttress 61 of upper connector member 53 abuts proximal lateral side 38 of rail 32, and buttress 63 abuts distal lateral side 40 of rail 32.

Support subassemblies 15 and 15' each further comprises plates 68 and 68'. As plates 68 and 68' are substantially identical, a description shall be made with reference to plate 68, wherein it is understood that, unless specifically stated otherwise, such description shall apply equally to plate 68'. Plate 68 comprises a front side 70 opposite to a back side 72, an anterior wall 74 oppositely situated to a posterior wall 76, and a bottom side 97 opposite to a top side 99. A hole 78 is formed through front side 70 and back side 72 towards anterior wall 74, and a hole 80 is formed through front side 70 and back side 72 towards posterior wall 76.

Each of support subassemblies 15 and 15' further comprises a lower connector member 82 which is disposed between plates 68 and 68'. Connector member 82 comprises a body 84 having two terminal ends located at 83 and 85.

A bolt 88 is positioned through holes 80 of plates 68 and 68' and through terminal ends 83 and 85 of lower connector member 82 to fixedly secure plates 52 and 52' to plates 68 and 68', while a bolt 89 is secured through holes 78 of plates 68 and 68' and through the hole located through distal lateral side 40 and proximal lateral side 38 towards posterior side 43 of rail 32 to fixedly secure plates 68 and 68' to rail 32.

Firefighter safety device 10 further comprises a rod 90 having a proximal terminal end 92 oppositely situated to a distal terminal end 94. Proximal terminal end 92 is disposed on front side 60 of plate 52' of support subassembly 15, while distal terminal end 94 is disposed on back side 62 of plate 52 of support subassembly 15'.

Based upon the configuration of support subassemblies 15 and 15' as described above, and as illustrated in the figures, it is apparent that the angle of foothold 12 may be adjusted based upon the movement of support subassembly 15. More particularly, by applying a directional force to rod 90, shafts 55 of upper connector members 53 of support subassemblies 15 and 15' respectively move through channels 45, and may be retained within a respective groove 48 to achieve a desired position for foothold 12.

Grip subassemblies 17 and 17' of mounting assembly 14 serve to secure firefighter safety device 10 to a roof. Each of grip subassemblies 17 and 17' are substantially identical. Accordingly, grip subassembly 17 shall be described, wherein it is understood that such description shall apply equally to grip subassembly 17 unless specifically stated otherwise.

Grip subassembly 17 comprises a bracket 102 and a bracket 104. Brackets 102 and 104 each respectively comprises a front side 106 and 108 opposite to a back side 110 and 112, wherein a hole 114 is formed through front side 106 and back side 110 and a hole 116 is formed through front side 108 and back side 112. A bolt 118 is disposed through holes 114 and 116 such that a shaft 120 of bolt 118 is disposed between brackets 102 and 104.

Grip subassembly 17 further comprises a grip member 122. Grip member 122 comprises a sleeve portion 124 which is disposed around shaft 120 such that grip member 122 is disposed between brackets 102 and 104, and such that grip member 122 is rotatable, at least partially, around shaft 120.

Grip member 122 further comprises a body 126, which is coextensive with sleeve portion 124. Body 126 comprises a front side 128 oppositely situated to a back side 130. Body 126 further comprises a generally arcuate shaped configuration wherein front side 128 comprises a concave curve 132. Body 126 terminates at a terminal end 134 which is oppositely situated to sleeve portion 124.

Each of grip subassemblies 17 and 17' are disposed on foothold 12 such that brackets 102 and 104 of each of grip subassemblies 17 and 17' are disposed on bottom side 20 of foothold 12 and such that grip members 122 of grip subassemblies 100 and 100' extend below posterior side 26 of foothold 12 and are orientated such that concave curve 132 is directed towards top side 18 of foothold 12.

Firefighter safety device 10 further comprises an operator securing assembly 150. Operator securing assembly 150 comprises a plate 152 having a longitudinally extending body 154. Body 154 comprises a top side 156 oppositely situated to a bottom side 158, a proximal lateral side 160 oppositely situated to a distal lateral side 162, and an anterior terminal end 164 oppositely situated to a posterior terminal end 166. Body 154 is positioned on bottom side 20 of foothold 12 such that posterior terminal end 166 is directed towards posterior side 26 of foothold 12 and anterior terminal end 164 is directed towards anterior side 24 of foothold 12. A hole 168 is formed through proximal lateral side 160 and distal lateral side 162 proximate to anterior terminal end 164.

Operator securing assembly 150 further comprises a substantially ring shaped member 170. Ring shaped member 170 comprises a substantially U-shaped body 172 having a terminal end 175 and a terminal end 177. A bolt 179 connects terminal end 175 to terminal end 177, and forms an opening 174 with body 172. A lanyard (not shown) may be attached to ring shaped member 170 at one end thereof and another end of the lanyard may be attached to a firefighter to protect the firefighter from falling from the roof.

An exemplary method of using firefighter safety device 10 comprises inserting bodies 126 of grip members 122 of grip subassemblies 17 and 17' through one or more cuts made through a roof through the use of, e.g., a chainsaw, while placing bottom sides 97 of plates 68 and 68' of structural supports 15 and 15' directly onto the roof. The curved configuration of grip members 122 creates stability in the hold of device 10 by the roof. Depending on the slope of the roof, a firefighter may adjust the angle of foothold 12 relative to support subassemblies 15 and 15' by either pulling rod 90 towards anterior end 24 of body 16 of foothold 12 or towards posterior end 26 of body 16, thereby, causing shafts 55 of upper connector members 53 of support subassemblies 15 and 15' to move along respective channels 45, and to catch within and be held by the appropriate grooves of plurality 48. A firefighter may then stand on top side 18 of foothold 12 to secure the firefighter's footing and balance when the firefighter is on the roof for purposes of, for example, venting the roof.

To prevent a firefighter from falling from the roof, the firefighter may secure a fastening member to both himself and to ring shaped member 170. In this manner, in the event the firefighter loses his balance and begins to fall from the roof, he may be caught through the tension established in the lanyard, thereby, preventing the firefighter from falling from the roof.

While the disclosure has been shown and described with reference to a certain preferred embodiment thereof, it will be understood by those skilled in the art that various changes in form and detail may be made therein without departing from the spirit and scope of the disclosure.

What is claimed is:

1. A safety device comprising:

a foothold comprising a body having a top side opposite to a bottom side, and an anterior wall opposite to a posterior wall;

a first support subassembly and a second support subassembly, wherein each of the first and second support subassemblies comprises:

a rail having a top side opposite to a bottom side, an anterior side opposite to a posterior side, and a proximal lateral side opposite to a distal lateral side, wherein a channel is formed through the rail, and further wherein the rail is disposed on the bottom side of the foothold;

a foothold adjustment subassembly comprising a plate which engages with the channel of the rail to thereby adjust the position of the foothold;

a roof rest member comprising a body which is in communication with the foothold adjustment subassembly and the rail, wherein a bottom side of the roof rest member is disposed on an exterior side of a roof when the device is in use;

a first grip subassembly and a second grip subassembly, wherein each of the first and second grip subassemblies comprises:

a grip member that is in physical communication with the roof when the safety device is installed on the roof;

a mount which is disposed on the back side of the foothold, and which extends past the posterior wall of the foothold, and further wherein the grip member from the first grip subassembly is in operable communication with the mount of the first grip subassembly and the grip member from the second grip subassembly is in operable communication with the mount of the second grip subassembly.

2. The safety device of claim 1, wherein each of the mounts of each of the first and second grip subassemblies comprises:

a first bracket and a second bracket, wherein each of the first and second brackets comprises an anterior portion opposite to a posterior portion, wherein the anterior portion is disposed on the bottom side of the foothold, and the posterior portion extends past the posterior wall of the foothold, and further wherein the posterior portion comprises a hole formed therethrough; and a bolt having a shaft which is disposed through the holes of the first and second brackets; wherein the grip member is engaged with the shaft of the bolt.

3. The safety device of claim 2, wherein each of the grip members from the first and second grip subassemblies comprises a sleeve which is contiguous with the arcuate shaped body, wherein the sleeve is disposed around the shaft such that the grip member is rotatable about the shaft.

4. The safety device of claim 2, wherein each of the foothold adjustment subassemblies of the first and second support subassemblies comprises:

a first plate and a second plate each comprising an anterior portion opposite to a posterior portion, and a front side opposite to a back side, wherein a first hole is formed through the front side and the back side of the anterior portion of the plate; and an upper connector member comprising a shaft, wherein the shaft is disposed through the holes of the first and second plates, and wherein the shaft is further disposed within the channel of the rail.

5. The safety device of claim 4, wherein each of the foothold adjustment subassemblies of the first and second support subassemblies further comprises a lower connector member comprising a body disposed between the first and second plates of each of the foothold adjustment subassemblies, wherein the body of the lower connector member is secured to the first and second plates of the foothold adjustment subassembly to allow for pivotal movement of the first and second plates relative to the body of the lower connector member.

6. The safety device of claim 5, wherein the roof rest member of each of the first and second support subassemblies comprises a first plate and a second plate, wherein each of the first plate and the second plate comprises an anterior portion opposite to a posterior portion, and a top side opposite to a bottom side, wherein the posterior portion is fixedly joined to the rail and the anterior portion is joined to the body of the lower connector member, and wherein the bottom side is disposed on the exterior side of the roof when the safety device is in use.

7. A safety device, comprising:

a foothold comprising a body having a top side opposite to a bottom side and an anterior wall opposite to a posterior wall;

a first support subassembly and a second support subassembly, wherein each of the first and second support subassemblies comprises:

a rail disposed on the bottom side of the foothold, wherein the rail comprises a proximal lateral side oppositely situated to a distal lateral side, wherein each of the proximal lateral side and the distal lateral side has a channel formed therethrough, wherein the channels of the proximal and distal lateral sides are in operable communication with one another;

an upper connector member having a first terminal end oppositely situated to a second terminal end, wherein the upper connector member is disposed through the rail such that the first terminal end extends from the channel formed through the proximal lateral side of the rail, and the second terminal end extends from the channel formed through the distal lateral side of the rail, wherein the connector is slidably engaged with the channel;

a first plate having an anterior end oppositely situated to a posterior end, wherein the anterior end of the first plate is attached to the first terminal end of the upper connector;

a second plate having an anterior end oppositely situated to a posterior end, wherein the anterior end of the second plate is attached to the second terminal end of the upper connector;

a third plate having an anterior end oppositely situated to a posterior end, wherein the anterior end is pivotally attached to the posterior end of the first plate, and the posterior end is fixedly attached to the proximal lateral side of the rail; and a fourth plate having an anterior end oppositely situated to a posterior end, wherein the anterior end is pivotally attached to the posterior end of the second plate, and the posterior end is fixedly attached to the distal lateral side of the rail;

a rod having a proximal terminal end oppositely situated to a distal terminal end, wherein the proximal terminal end is disposed on the second plate of the first support subassembly and the distal terminal end is disposed on the first plate of the second support subassembly; and a first grip subassembly and a second grip subassembly, wherein each of the first grip subassembly and the second grip subassembly comprises:

a first bracket and a second bracket, each having a first terminal end oppositely situated to a second terminal end, wherein the first terminal end is attached to the bottom side of the foothold, and the second terminal end extends past the posterior edge of the foothold;

a shaft disposed between the first bracket and the second bracket towards the posterior edge of the foothold;

a grip member having:

a sleeve rotatably mounted onto the shaft; and an arcuate shaped body, wherein a concave portion of the arcuate shaped body is directed towards the top side of the foothold.

8. The safety device of claim 7, further comprising an operator securing assembly, wherein the operator securing assembly comprises:

a plate having a top side opposite to a bottom side, and an anterior portion opposite to a posterior portion, wherein the anterior portion of the plate is directed towards the anterior wall of the foothold, the posterior portion of the plate is directed towards the posterior wall of the foothold, and further wherein the plate is disposed on the bottom side of the foothold; and a member attached to the anterior portion of the plate of the operator securing assembly, wherein the member comprises an opening which receives a fastening member which assists in securing an operator to the safety device.

* * * * *